US005249701A

United States Patent [19]

Daehn

[11] Patent Number: 5,249,701

[45] Date of Patent: Oct. 5, 1993

[54] AEROSOL CONTAINER WITH PRESSURE RELEASE STRUCTURE

[75] Inventor: Ralph C. Daehn, Wayne, Ill.

[73] Assignees: Ray J. Van Thyne, Prospect Heights; Christian F. Kinkel & Materials Engineering, Inc., Wayne, both of Ill.

[21] Appl. No.: 884,735

[22] Filed: May 15, 1992

[51] Int. Cl.[5] ..... B65D 8/27

[52] U.S. Cl. ..... 220/612; 220/620; 220/678

[58] Field of Search ..... 220/612, 620, 678

[56] References Cited

U.S. PATENT DOCUMENTS

| | | | |
|---|---|---|---|
| 669,117 | 3/1901 | Judd | 220/612 |
| 1,268,980 | 6/1918 | Krumholz | 220/612 |
| 1,298,482 | 3/1919 | Dunham | 220/612 |
| 1,305,652 | 6/1919 | Karl | 220/620 |
| 1,927,255 | 9/1933 | Brown | 220/612 |
| 2,323,316 | 7/1943 | Dieter | 220/612 |
| 2,335,451 | 11/1943 | Saulnier | 220/612 |
| 2,354,921 | 8/1944 | McClary | 220/612 |
| 2,427,823 | 9/1947 | Turney, Jr. | 220/612 |
| 2,795,350 | 6/1957 | Lapin . | |
| 3,680,743 | 8/1972 | Reinnagel . | |
| 3,724,727 | 4/1973 | Zundel . | |
| 3,786,967 | 1/1973 | Giocomo et al. . | |
| 3,831,822 | 8/1974 | Zundel . | |
| 3,850,339 | 11/1974 | Kinkel . | |
| 3,918,610 | 11/1975 | Willis . | |
| 4,854,467 | 8/1989 | Budenbender | 220/612 |

*Primary Examiner*—Joseph Man-Fu Moy
*Attorney, Agent, or Firm*—Emrich & Dithmar

[57] ABSTRACT

The container comprises a tubular side wall and two end walls joined to the ends thereof by a double-seam construction. A plurality of interrupted welds are provided at the joint between one end wall and the adjacent end of the side wall.

16 Claims, 2 Drawing Sheets

AEROSOL CONTAINER WITH PRESSURE RELEASE STRUCTURE

BACKGROUND OF THE INVENTION

1. Field of the Invention

Aerosol containers are usually pressurized to approximately 70 psi at room temperature. This pressurization enables the contents to be expelled via a valve controlled by the user. Most aerosol containers are of three-piece construction consisting of a seamed side wall, an outwardly domed top wall and an inwardly domed bottom wall. The top and bottom walls are fastened to the cylindrical side wall by a mechanically formed double seam, with a sealing compound incorporated into the seam. The valve assembly is mechanically attached to the top wall after the container is filled. Two-piece containers are also used, wherein one end and the side wall are made in one piece by forming.

Pressurization of the container is achieved by adding a high vapor pressure fluid, or propellant, to the product during the final step of the filling process. The propellant maintains an internal pressure within the container from full to empty. In the past, chlorinated fluorocarbons were used as aerosol propellants, but their use has been discontinued in aerosol packaging due to environmental consideration. The propellants currently used typically are butane, isobutane, propane or a mixture of them. All of these propellants are highly flammable and present a fire hazard. They are similar to chlorinated fluorocarbons in pressure-temperature relationship. This has allowed them to be substituted for chlorinated fluorocarbons in aerosol containers without change. Non-flammable, environmentally safe propellants are available, but are not currently economical alternatives. The vapor pressure of these propellants is significantly higher than the pressures of current or past propellants. To utilize these propellants in an aerosol container, requires changes to the container to allow safe containment of the contents at the increased internal pressure. To date, changes to the container allowing increased pressure containment capacity have not been economically successful.

Changing to a non-flammable, environmentally safe propellant is desirable. Achieving this will require an improved aerosol container capable of increased internal pressure containment capacity due to the increased pressures associated with these propellants. Solely achieving higher pressure containment capacity in an aerosol container will increase the temperature and pressure at which the container bursts, but will increase the potential danger from bursting. The danger arises from the increased stored energy due to the higher pressure storage of product and propellant. This increased stored energy will be released as kinetic energy if the container bursts.

Therefore, it is important that a higher pressure aerosol container vent rather than burst. The controlled release of the aerosol container contents, prior to a pressurization that could cause catastrophic or explosive rupturing of the container, will avoid the dangers due the bursting of an aerosol container. In order to provide a balanced approach to a safer aerosol container, it must incorporate higher internal pressure capacity features allowing the use of non-flammable environmentally safe propellants, while also including a pressure release system for controlled release of the container pressure during over pressurization conditions.

2. The Prior Art

The prior art has approached the improvements for increases in internal pressure capacity of the aerosol containers and the formulation of a controlled pressure release system separately. Past efforts to increase the pressure containment capacity of aerosol containers has primarily centered around material strength. The thickness and/or strength of the material were increased to provide a stronger container with inherently more pressure containment capacity. The containers resulting from these efforts are not economical for production and therefore are not viable. Several of the more typical high-pressure container designs have not been able to become economically viable due to the cost of the materials used in each container and manufacture costs. However, increasing the internal pressure of current production containers causes failures in the mechanical attachment of the ends to the body, not in the material from which the container is constructed.

Past efforts to provide for pressure release in aerosol containers have centered around mechanical devices and/or introduction of artificial weakness to the container. The devices would open a valve or the like in the container when the internal pressure reached a specific level. U.S. Pat. No. 3,714,965 to Bentley disclose a pressure activated valve on the container. Pressure activated valves integrated into the valve cup assembly are disclosed in U.S. Pat. Nos. 3,722,759 to Rodden and 3,866,804 to Stevens. U.S. Pat. No. 3,912,130 to Pelton discloses vents in the double seam of the dome, which vents open when the dome buckles due to over pressurization. These devices however have been plagued by such problems as high acquisition costs, manufacturing difficulties and unacceptable performance reliability. As a result, these devices have not been widely incorporated into commercial production aerosol containers in any form.

The introduction of artificial weakness into aerosol containers have recently had limited commercial production application. U.S. Pat. Nos. 3,850,339 to Kinkel, 4,513,874 to Mulawski and 4,588,101 to Ruegg disclose devices of this nature. These weaknesses can be broadly characterized as scores in the metal that are intended to locally fracture the material when a specific pressure range is reached or a specific over pressurization event occurs, such as to outwardly buckle the dome. These pressure release mechanisms are highly dependent on the manufacturing processes and control introducing the scoring to the metal. For the weakened area to fracture at the proper pressure, the tolerances of the manufacturing process must closely be controlled and the material must meet very precise specifications with consistency.

SUMMARY OF THE INVENTION

The present invention significantly improves the operating pressure range of aerosol containers and provides for a pressure release. Bonding is applied to the double seams of the container. This increases the strength of the mechanical attachment of the ends to the body. Such bonding increases the strength of the container sufficiently that the container material itself is the limiting aspect of its container strength.

In summary, there is provided an aerosol container comprising a tubular side wall and an end wall joined thereto, a plurality of interrupted bonds between the end wall and the adjacent end of the side wall.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
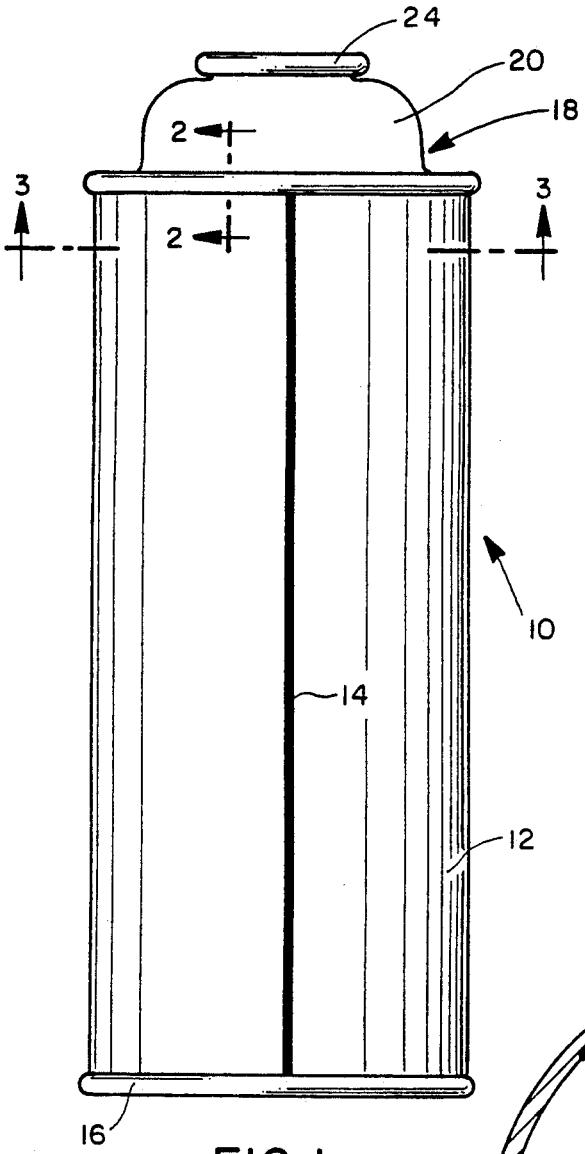
FIG. 1 is a side elevational view of an aerosol container incorporating the features of the present invention.

Referring now to the drawings and more particularly to FIG. 1 thereof, there is illustrated an aerosol container 10 incorporating the features of the present invention. Container 10 comprises a sheet-metal, side wall bent in the form of a cylinder and welded along line 14. An end or bottom wall 16 is welded to side wall 12 at one end thereof, and an end or top wall 18 is welded to side wall 12 at the other end thereof. In another form of the invention, side wall 12 and bottom wall 16 are formed from a single piece of sheet metal and there is no weld 14. In the embodiment depicted, top wall 18 has a dome 20 ending in an orifice 22 (FIG. 3) defined by a top curl 24.

Figure 2:
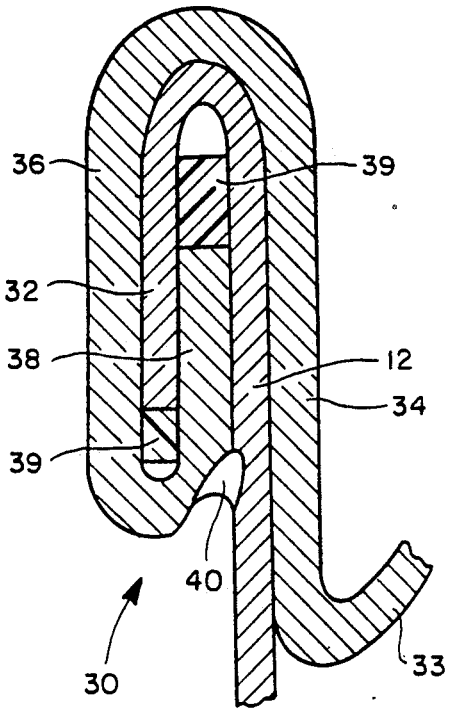
FIG. 2 is an enlarged view in vertical section taken along the line 2—2 of FIG. 1.

FIG. 2 depicts the manner in which top wall 18 is attached to the upper end of side wall 12, utilizing a standard double seam 30. Specifically, the upper end of side wall 12 is bent over to form a cylindrical flange 32 spaced from and concentric with side wall 12. Top wall 18 has a portion 33 which merges into dome 20. Top wall 18 is bent to form a cylindrical flange 34, in turn bent back on itself to provide a cylindrical flange 36 which is in turn bent on itself to provide a cylindrical flange 38. Flange 32 is located between flanges 36 and 38, and side wall 12 is located between flanges 34 and 38. This is a standard so-called "double-seam" construction used in aerosol containers. A similar construction may be employed in connecting bottom wall 16 to the corresponding end of side wall 12. If the alternative, one-piece construction of side wall 12 and bottom wall 16 is employed, then of course, no such double-seam joint between the two would be present.

Before assembly, sealing compound is applied to top wall 18 around its periphery and/or to side wall 12 at its upper end. When the parts are assembled, sealing compound will be disposed between adjacent surfaces, principally between the interface of flanges 32 and 36 and between the interface of flanges 36 and 38. The sealing compound 39 squeezes into the space next to the end of flange 38 and between side wall 12 and into the space next to the end of flange 32 and between flanges 36 and 38.

After container 10 is filled, a valve cup (not shown) is placed onto top curl 24 and mechanically crimped in place. Container 10 is filled with a propellant to pressurize it. A valve (not shown) is mounted on the valve cup to enable the product and the propellant to be dispensed.

Top wall 18 is bonded to side wall 12 preferably at the joint between the lower end of flange 36 and side wall 12. Preferably, the bonds are welds although interrupted adhesive bonds are within the scope of the invention.

Figure 3:
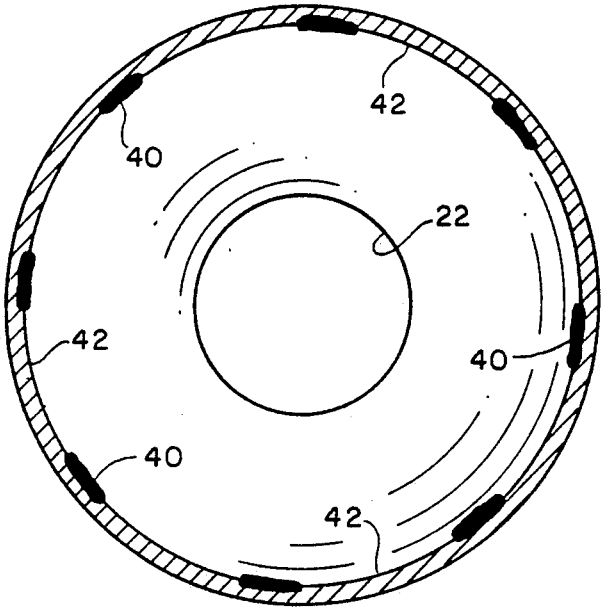
FIG. 3 is an enlarged view in horizontal section taken along the line 3—3 of FIG. 1.

Attachment is by means of a plurality of interrupted bonds, preferably welds 40 created by laser, as is best seen in FIG. 3. In the particular embodiment depicted, there are eight welds 40, each 11° in angular extent, and eight gaps 42 between the welds each about 34° in extent.

Bottom wall 16 can be attached to the adjacent end of side wall 12 in a similar way, although a continuous weld may be used as well. Or, a continuous weld may be used to attach top wall 18 to side wall 12 and interrupted welds, like those shown in FIG. 3, used to attach bottom wall 16 to side wall 12. Or, both ends can employ an interrupted welding construction like that shown in FIG. 3.

Figure 4:
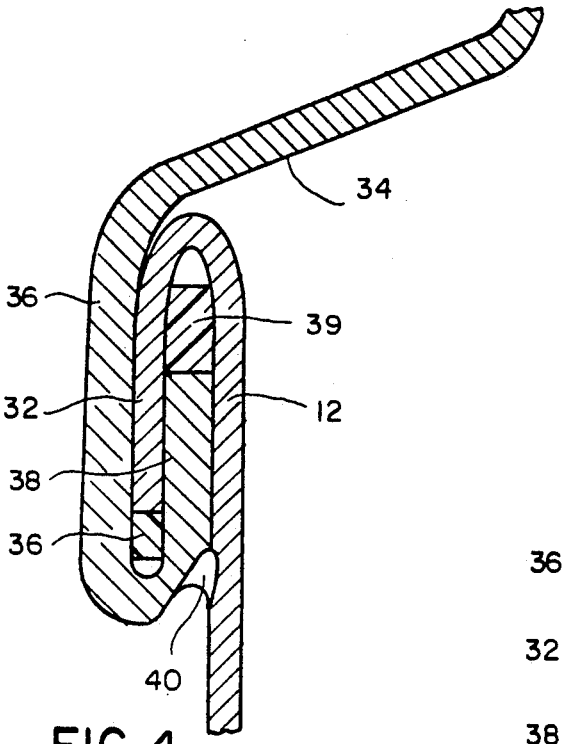
FIG. 4 is a view like FIG. 2, but at a time when the pressure in the can is such as to cause its top wall to deform.
Figure 5:
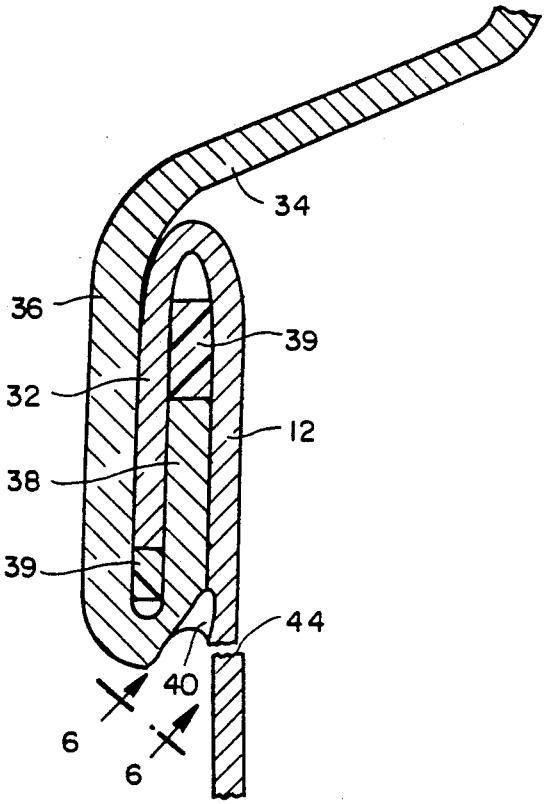
FIG. 5 is a view like FIG. 4, but with a greater interior pressure sufficient to rupture its side wall.
Figure 6:
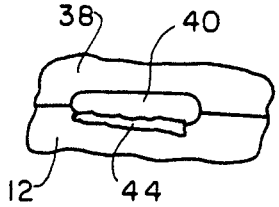
FIG. 6 is an enlarged view taken along the line 6—6 of FIG. 5.

Over pressurization of container 10 causes top wall 18 to buckle upwardly, as depicted in FIG. 4. Thus, flange 34, which was alongside side wall 12, buckles upwardly. Continued pressure increase will cause the container to fail adjacent to welds 40. As depicted in FIGS. 5 and 6, a crack or tear 44 appears next to weld 40 through which pressure is relieved. These tears or cracks act as vents to relieve pressure so that catastrophic bursting of the container does not occur. One or more such tears will occur, but each is adjacent to a weld 40, as depicted in FIG. 6. Welds 40 also increase the strength of the container.

Standard aerosol cans in the past burst at about 280 psi. With the present invention, the failure in the can did not occur until 350 psi or more. And, at failure, the can did not burst, but rather vented. Thus, the present invention involves a higher pressure before failure occurs and no bursting at failure.

Figure 7:
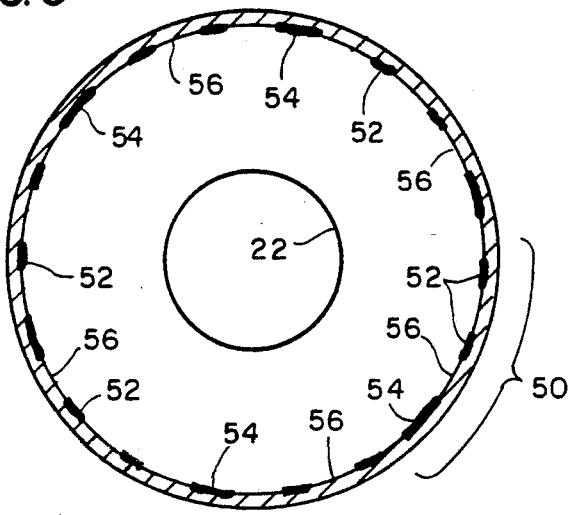
FIG. 7 is a view like FIG. 3, but depicting another welding pattern.

A second format for the bonds is depicted in FIG. 7. They are arranged in six groups or triads 50 of three welds each, two welds 52 of relatively short angular extent and one weld 54 of relatively long angular extent. In a particular embodiment, each of welds 52 had an angular extent of 5° and each of welds 54 had an angular extent of 10°. In the particular embodiment depicted, all gaps 56 had the same angular extent, each about 13°.

What has been described, therefore, is an improved aerosol container with pressure relieving structure such that when the container is under excessive pressure, instead of bursting explosively, small tears in the body or side wall occur which act as vents through which the pressure can be relieved.

What is claimed is:

1. An aerosol container comprising a tubular side wall, a first end wall at one end of said side wall for receiving a dispensing valve, said second end wall including a portion overlying the outside of said side wall, the joint between said side wall and said second end wall being a double seam, and a plurality of interrupted welds between said second end wall and the adjacent end of said side wall.

2. The aerosol container of claim 1, and further comprising an uninterrupted bond between said first end wall and said other end of said side wall.

3. The aerosol container of claim 1, and further comprising a sealant in said double seam.

4. The aerosol container of claim 1, wherein said first end wall is outwardly domed.

5. The aerosol container of claim 1, wherein said welds are at least of two different lengths.

6. The aerosol container of claim 1, wherein all of said welds are substantially the same length.

7. The aerosol container of claim 1, wherein said plurality is eight or nine.

8. The aerosol container of claim 1, wherein each of said welds has an angular extent of about 11°.

9. The aerosol container of claim 1, wherein each of said welds has an angular extent of about 5.5°.

10. The aerosol container of claim 1, wherein said plurality of uninterrupted welds includes some welds of a first angular extent and some welds of a second angular extent.

11. The aerosol container of claim 10, wherein said first angular extent is about 10° and said second angular extent is about 5°.

12. The aerosol container of claim 1, wherein said plurality of uninterrupted welds includes a number of triads of welds, each triad having two welds of a shorter first angular extent and one weld of a longer second angular extent.

13. The aerosol container of claim 12, wherein said number is six.

14. The aerosol container of claim 1, wherein each of said welds is a laser weld.

15. The aerosol container of claim 1, wherein the welds are at the crevice between the double seam and the sidewall.

16. The aerosol container of claim 15, and further comprising a sealant in said double seam.

* * * * *

UNITED STATES PATENT AND TRADEMARK OFFICE

CERTIFICATE OF CORRECTION

PATENT NO. : 5,249,701

DATED : October 5, 1993

INVENTOR(S) : Ralph C. Daehn

It is certified that error appears in the above-indentified patent and that said Letters Patent is hereby corrected as shown below:

Column 5, line 3, after "valve,"insert --and a second end wall at the other end of said side wall,--;

Signed and Sealed this

Nineteenth Day of April, 1994

Bruce Lehman

*Attest:*

BRUCE LEHMAN

*Attesting Officer*

*Commissioner of Patents and Trademarks*